US005368695A

United States Patent [19]

Uryu

[11] Patent Number: 5,368,695

[45] Date of Patent: Nov. 29, 1994

[54] METHOD FOR PRODUCING AN ACOUSTIC VIBRATION PLATE

[75] Inventor: Masaru Uryu, Chiba, Japan

[73] Assignee: Sony Corporation, Tokyo, Japan

[21] Appl. No.: 29,572

[22] Filed: Mar. 11, 1993

Related U.S. Application Data

[62] Division of Ser. No. 883,547, May 15, 1992.

[51] Int. Cl.[5] ..... D21J 3/12; D21J 5/00

[52] U.S. Cl. ..... 162/228; 162/103

[58] Field of Search ..... 162/231, 218, 219, 228, 162/103, 201; 181/169, 170; 264/86, 85; 427/439, 440; 156/285

[56] References Cited

U.S. PATENT DOCUMENTS

| | | | |
|---|---|---|---|
| 1,717,775 | 6/1929 | Hawley | 162/219 |
| 1,819,300 | 8/1931 | Newcombe | 181/169 |
| 1,838,904 | 12/1931 | Chaplin | 162/219 |
| 1,848,056 | 3/1932 | Chaplin | 162/231 |
| 2,369,488 | 2/1945 | Perry | 162/224 |
| 2,460,129 | 1/1949 | Ista | 162/219 |
| 2,494,743 | 1/1950 | Chaplin | 162/224 |
| 3,253,970 | 5/1966 | Williams | 181/169 |
| 3,935,924 | 2/1976 | Nagao et al. | 162/141 |
| 4,374,702 | 2/1983 | Turbak et al. | 162/9 |
| 4,847,981 | 7/1989 | Suzuki et al. . | |

FOREIGN PATENT DOCUMENTS

| | | | |
|---|---|---|---|
| 0424841 | 5/1991 | European Pat. Off. . | |
| 3018659 | 11/1981 | Germany . | |
| 0038319 | 4/1978 | Japan | 181/169 |
| 0007751 | 2/1980 | Japan | 181/169 |

*Primary Examiner*—W. Gary Jones
*Assistant Examiner*—Brenda Adele James
*Attorney, Agent, or Firm*—Hill, Steadman & Simpson

[57] ABSTRACT

An acoustic diaphragm employed in a speaker or the like and a method for producing the acoustic diaphragm are disclosed. A diaphragm substrate is a diaphragm exhibiting air permeability, such as a paper diaphragm. The substrate is processed with filling by microfibrillated pulp. For filling, the substrate is immersed in the liquid dispersion of the microfibrillated pulp and the pulp is deposited on the substrate under suction. When the microfibrillated pulp is deposited on the substrate under suction, any voids present in the substrate are closed by the microfibrillated pulp so that air tightness is improved without lowering the sound quality or detracting from desirable properties of the diaphragm, such as low density, high toughness and low losses.

6 Claims, 2 Drawing Sheets

METHOD FOR PRODUCING AN ACOUSTIC VIBRATION PLATE

This is a division of application Ser. No. 07/883,547, filed May 15, 1992 pending.

BACKGROUND OF THE INVENTION

1. Field of the Invention

This invention relates to an acoustic diaphragm, a method for producing the acoustic diaphragm and an improved method for filling a paper diaphragm.

2. Description of the Prior Art

Materials other than paper, such as high polymer materials metals or ceramics, are coming into use as an acoustic diaphragm material. However, the paper diaphragm produced by a paper making technique from cellulose fibers still accounts for a major portion of the currently employed acoustic diaphragms, because the paper diaphragm has such advantages that it may be produced easily, exhibits moderate internal losses and may successfully cope with a wide variety of sound quality requirements because it meets a wide variety of factors governing the sound quality, such as pulp types, freeness or fillers.

Meanwhile, since paper diaphragms are prepared by the paper making technique, it is inevitable that these occupy a more or less large space while exhibiting certain air permeability. Thus, for assuring air tightness of the paper diaphragm, a processing operation called filling is carried out.

Conventional filling operations include laminating a film composed mainly of a high polymer material and exhibiting air tightness on the paper diaphragm surface, or applying a coating composed of a high polymer material dissolved or emulsified in an organic solvent on the paper diaphragm.

However, these filling operations detract from the merits related to the paper diaphragms, namely low density, high toughness and low losses. Besides, since the paper diaphragm material is mixed with heterogeneous materials, the high sound quality proper to the paper diaphragm tends to be affected adversely.

For overcoming these disadvantages, it may be contemplated to prepare paper diaphragms by a so-called mixed paper making technique by adding highly beaten pulp or microfibrilated cellulose during preparation of the paper diaphragm.

With this method, heterogenous materials are not mixed, while the sound quality is not affected significantly.

However, since this method is based essentially on the paper making technique, it is difficult to overcome the problem of air permeability of the diaphragm completely. On the other hand, with the method by mixed paper making, the diaphragm is increased in density, although the sound quality associated with the paper diaphragm is not lost.

OBJECT AND SUMMARY OF THE INVENTION

It is therefore an object of the present invention to provide a method for producing an acoustic diaphragm having improved air tightness without lowering the properties of the paper diaphragm, that is low density, high toughness and low losses.

The present invention provides for immersing a substrate formed from paper by the paper making technique in a liquid dispersion of microfibrillated pulp and depositing the microfibrillated pulp on said substrate under suction effects.

When the microfibrillated pulp is deposited on the paper diaphragm under suction effects, any voids present in the paper diaphragm are stopped up with the microfibrillated pulp to lower air permeability.

Since it is the microfibrillated pulp, which is of the same material as the paper, that functions as the filler, the desirable sound property of the paper diaphragm is not lost, while the desirable properties of the paper diaphragm, that is the low density, high toughness or low losses, are not impaired.

On deposition of the microfibrillated pulp, a large number of hydrogen bonds are produced between the fibers to produce high modulus of elasticity. Since the material exhibiting high modulus of elasticity is present on the surface, the diaphragm obtained in accordance with the present invention may be improved in modulus of elasticity.

That is, since the microfibrillated pulp is deposited on the surface of the paper diaphragm for filling, the diaphragm may be improved in air tightness without lowering the sound quality or degrading the desirable properties of the paper diaphragm.

DETAILED DESCRIPTION OF THE PREFERRED EMBODIMENTS

The present invention will be explained hereinbelow with reference to Examples in conjunction with the drawings and the results of experiments.

Technique of Suction and Deposition

Figure 1:
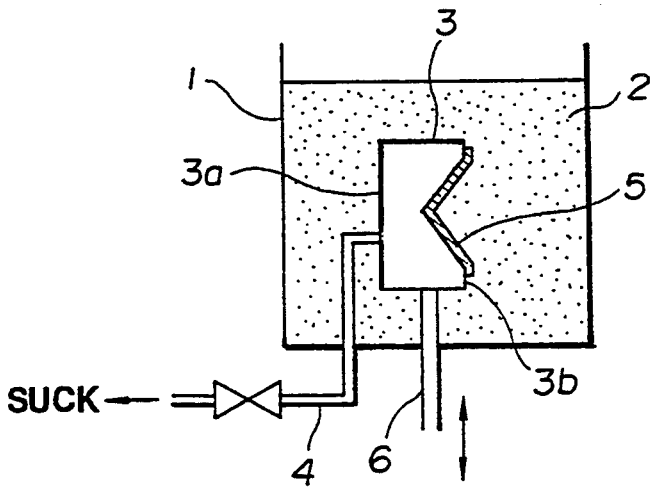
FIG. 1 is a schematic view showing a typical construction of a suction paper making device for sucking and depositing microfibrillated pulp.

According to the present invention, microfibrillated pulp is sucked and deposited on the surface of a paper diaphragm. FIG. 1 shows an example of a suction type paper making device for sucking and depositing microfibrillated pulp.

The suction paper making device, shown in FIG. 1, is made up of a liquid suspension tank 1, containing a dispersed liquid of microfibrilated pulp, a suction casing 3, dipped in the liquid pulp dispersion 2 contained in the liquid suspension tank 1, and a vacuum pump, not shown, for evacuating the inside of the suction casing by means of a suction pipe 4 provided on a back side 3*a* of the suction casing 3.

A forward side 3*b* of the suction casing 3 is formed with an opening conforming to the shape of a paper diaphragm substrate 5 so that the opening is tightly closed by the paper diaphragm substrate 5. The suction casing 3 is supported by a vertically movable supporting shaft 6 so that the casing is lifted to a position above the liquid level of the liquid pulp dispersion 2 for loading the diaphragm substrate 5 and then the casing 3 is lower so that the substrate 5 is immersed in the liquid pulp dispersion 2 after loading the diaphragm substrate on the casing 3.

The substrate 5 needs to be endowed with air permeability so that it may, for example, be a paper diaphragm. The paper diaphragm is prepared by usual paper making technique from any desired pulp material. The substrate shape is also optional as a function of the desired diaphragm shape. The substrate shown herein is a usual cone paper.

The microfibrilated pulp, contained in the liquid pulp dispersion 2, may be cellulose obtained from plants (usual pulp as starting material in paper making) beaten to Canada standard freeness of not more than 300 ml or may be microfibrilated cellulose having the Canada standard freeness of not more than 300 ml from the outset, that is without beating. An example of the latter is bacteria cellulose produced by bacterial cultivation.

For sucking and depositing the microfibrilated pulp on the diaphragm substrate 5, the latter is loaded for tightly closing the opening of the suction casing 3 and immersed in the liquid pulp dispersion 2 whilst the inside of the casing is evacuated by the vacuum pump.

Figure 2:
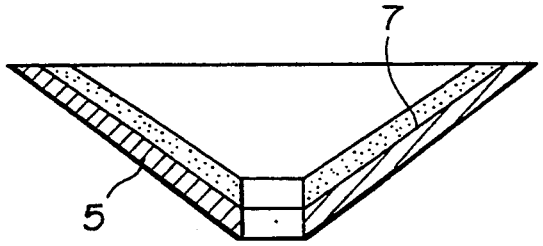
FIG. 2 is a schematic cross-sectional view showing a conical acoustic diaphragm onto which microfibrillated pulp is sucked and deposited.

The liquid pulp dispersion 2 is sucked from the rear side of the diaphragm substrate 5 so as to be permeated through the diaphragm substrate 5. At this time, the microfibrilated pulp in the liquid pulp dispersion is deposited to fill up any voids in the substrate 5 so that a deposited layer 7 as shown in FIG. 2 is formed on the surface of the paper diaphragm substrate 5.

The deposited layer 7 may be formed on a front side or on a rear side of the diaphragm substrate 5 depending on the mounting direction of the diaphragm substrate 5 with respect to the suction casing 3.

Although the deposited layer 7 may have any desired thickness, it is preferred for the dry thickness of the deposited layer 7 to be 5 μm or more for demonstrating sufficient filling effects.

The thickness or the volume of the deposited layer 7 may be controlled by the degree of vacuum reached during evacuation, evacuation time or the concentration of the liquid pulp dispersion 2. For example, the higher the concentration of the liquid pulp dispersion 2, the shorter is the time necessary to form a thick deposited layer 7. However, the concentration of the liquid pulp dispersion 2 is preferably 1% or less. If the concentration is excessive, the liquid is increased in viscosity to render handling difficult.

After forming the deposited layer 7 by evacuation, the substrate is processed with pressing to remove any moisture and dried to complete the acoustic diaphragm.

Figure 3:
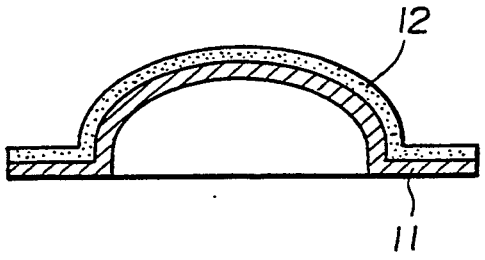
FIG. 3 is a schematic cross-sectional view of a dome-shaped acoustic diaphragm onto which microfibrillated pulp is sucked and deposited.

The diaphragm substrate 5 may also be dome-shaped, as shown in FIG. 3, instead of being a cone paper, as in the above-described embodiment. In this case, a deposited layer 12 of microfibrilated pulp may be deposited on the surface of a flat paper diaphragm substrate under suction effects by using the same technique as described above and the resulting substrate is processed into a desired dome shape with drawing by means of a metal mold having a semispherical recess and a die having a mating projection.

Preparation of Paper Diaphragm Substrate

For preparing an acoustic diaphragm in the above-described manner, a paper diaphragm substrate was first prepared in accordance with a composition shown in Table 1.

TABLE 1

| | COMPOSITION (%) | BEATING DEGREE (ml) |
|---|---|---|
| KRAFT PULP | 75 | 500 |
| SULFITE PULP | 15 | 540 |
| MANILA HEMP | −10 | 600 |

Two paper diaphragm samples, weighing 2.0 g and 2.5 g and both having a diameter of 12 cm, were prepared.

EXAMPLE 1

The Kraft pulp, employed in the preparation of the paper diaphragm substrate samples, was beaten to a Canadian standard freeness of 300 ml, using a beater, to produce a liquid pulp dispersion having a concentration of 0.2%.

The operation of suction and deposition on the paper diaphragm substrate sample was performed in this liquid pulp dispersion to produce an acoustic diaphragm sample. The duration of suction and deposition was one minute. The substrate sample employed in the present Example was that 2.5 g in weight. On this sample, 0.5 g of the Kraft pulp, beaten to the Canadian standard freeness of 300 ml, was deposited.

EXAMPLE 2

1.0 g of the Kraft pulp, beaten to the Canadian standard freeness of 300 ml, was deposited on the surface of the paper diaphragm substrate sample, weighing 2.0 g, in the same manner as in Example 1, except using different time of suction and deposition.

EXAMPLE 3

Using the microfibrilated pulp, in a pasty state, with the Canadian standard freeness of not more than 300 ml, manufactured and sole by DAISEL KAGAKU KOGYO KK under the trade name of MFC, a liquid pulp dispersion having a concentration of 0.2% was prepared and the operation of suction and deposition on the surface of the paper diaphragm sample was performed in this liquid pulp dispersion to produce an acoustic diaphragm.

0.5 g of the above pulp was deposited on the above-mentioned paper diaphragm substrate sample weighing 2.0 g.

Comparative Example 1

A paper diaphragm substrate sample, having the same composition as that shown in the preceding Examples, but weighing 3.0 g, was prepared, and directly used as Comparative Example.

Comparative Example 2

30 wt. % of the highly beaten Kraft pulp, employed in Example 1, were added to the composition of the paper diaphragm substrate sample of the preceding Examples, and a paper diaphragm sample weighing 3.0 g was prepared by using the paper making technique.

Comparative Example 3

30 wt. % of the microfibrilated cellulose, manufactured and sold by DAISEL KAGAKU KOGYO KK under the trade name of MFC, employed in Example 2, was added to the composition of the paper diaphragm substrate sample employed in the preceding Examples, to try to prepare a paper diaphragm by the paper making technique. However, it was impossible to produce the diaphragm because of extremely poor freeness.

Comparative Example 4

A nylon film 50 μm thick was laminated on the surface of the paper diaphragm substrate sample, which was the same as that of Example 1, to produce a composite diaphragm.

The inner losses I, density D, Young's modulus, longitudinal wave propagation velocity (sound velocity) C and the degree of vacuum reached were measured for the diaphragms produced in the above Examples and Comparative Examples. The results are shown in Table 2.

Figure 4:
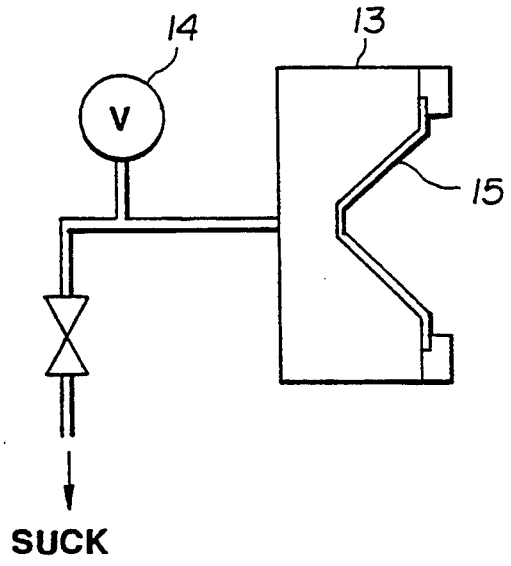
FIG. 4 is a schematic view showing a typical construction of a device for measuring the degree of vacuum reached with the diaphragm.

The modulus of elasticity was measured by a vibration reed method, while air permeability was judiciously evaluated by measuring the degree of vacuum reached using a measuring device shown in FIG. 4. The measuring device shown in FIG. 4 is made up of a casing 13 similar to the casing 3 used during suction and deposition, a vacuum pump, a rotary oil pump having a displacement volume of 20 liters per minute, not shown, and a vacuum meter 14 provided halfway in the evacuating system. A diaphragm sample 15 was fitted on the casing 13 as shown and the inside of the casing was evacuated to perform the operation of suction and deposition. The degree of vacuum reached in three minutes since the start of evacuation was measured with the vacuum meter 14.

TABLE 2

| | I (tan δ) | D (g/cm$^3$) | B (Gpa) | C (m/sec) | V (mmHg) |
|---|---|---|---|---|---|
| EX. 1 | 0.040 | 0.548 | 2.4 | 2090 | 170 |
| EX. 2 | 0.038 | 0.577 | 4.1 | 2670 | 85 |
| EX. 3 | 0.038 | 0.598 | 2.8 | 2160 | 55 |
| COMP. EX. 1 | 0.040 | 0.518 | 1.5 | 1700 | 500 |
| COMP. EX. 2 | 0.033 | 0.572 | 2.1 | 1920 | 370 |

TABLE 2-continued

| | I (tan δ) | D (g/cm$^3$) | B (Gpa) | C (m/sec) | V (mmHg) |
|---|---|---|---|---|---|
| COMP. EX. 4 | 0.040 | 0.622 | 1.5 | 1550 | 50 |

It is seen from Table 2 that high air tightness and improved physical properties are realized with the diaphragms of the Examples as compared to those of the Comparative examples.

What is claimed is:

1. A method for producing an acoustic diaphragm comprising the steps of:

providing a paper substrate;

supporting the substrate on a suction case;

immersing the substrate and suction case into a liquid dispersion of microfibrillated pulp; and applying a suction to draw liquid through the paper substrate and to deposit a layer of the microfibrillated pulp on an exposed surface of the paper substrat

2. A method as claimed in claim 1 wherein the layer of microfibrillated pulp deposited on said substrate has a dry thickness of at least 5 μm.

3. A method according to claim 1, wherein the step of providing a paper substrate provides a paper cone with a shape of a completed acoustic diaphragm.

4. A method according to claim 1, wherein the step of providing the paper substrate provides a sheet of paper and the method includes shaping the substrate with the layer of microfibrillated pulp into the shape of a completed acoustic diaphragm by pressing the substrate with the layer of microfibrillated pulp and then drying the pressed substrate

5. A method according to claim 1, which includes the steps of pressing the substrate with the layer of microfibrillated pulp to remove liquid and then drying the pressed substrate.

6. A method according to claim 3, which further comprises the steps of pressing the substrate with the layer of microfibrillated pulp and then drying the pressed substrate.

* * * * *